US005207252A

United States Patent [19]

Risse

[11] Patent Number: 5,207,252

[45] Date of Patent: May 4, 1993

[54] APPARATUS FOR CLAMPING A WORKPIECE IN WHICH A MORTISE IS FORMED

[76] Inventor: Timothy J. Risse, 9014 W. Auer Ave., Milwaukee, Wis. 53222

[21] Appl. No.: 864,580

[22] Filed: Apr. 7, 1992

[51] Int. Cl.[5] ..... B27F 5/00

[52] U.S. Cl. ..... 144/84; 144/73; 269/43; 269/172; 269/219; 269/288; 269/902

[58] Field of Search ..... 269/43, 111, 140, 146, 269/152, 172, 219, 244, 287, 288, 902; 144/72, 73, 84

[56] References Cited

U.S. PATENT DOCUMENTS

| | | | |
|---|---|---|---|
| 112,228 | 2/1871 | Downing et al. . | |
| 268,003 | 11/1882 | Daniels . | |
| 306,404 | 10/1884 | Kraus . | |
| 410,975 | 9/1889 | Jesson et al. . | |
| 1,015,497 | 1/1912 | Koster . | |
| 1,186,682 | 6/1916 | Rahmel . | |
| 2,562,131 | 7/1951 | Scovill | 269/219 X |
| 2,569,239 | 9/1951 | Holmen | 269/140 X |
| 2,848,785 | 8/1958 | Bachli et al. | 269/146 X |
| 4,074,897 | 2/1978 | Behn | 269/43 |
| 4,527,786 | 7/1985 | Hsu | 269/16 |
| 4,934,675 | 6/1990 | Klocke | 269/111 |
| 5,067,537 | 11/1991 | Offner | 144/371 |

FOREIGN PATENT DOCUMENTS

| | | | |
|---|---|---|---|
| 467925 | 12/1951 | Italy | 144/83 |

*Primary Examiner*—W. Donald Bray
*Attorney, Agent, or Firm*—Foley & Lardner

[57] ABSTRACT

The present invention provides an apparatus for holding a workpiece which, according to one aspect of the invention, has a pair of clamping members configured to securely hold a workpiece in which a mortise is to be formed. The clamps are mounted on a frame which has generally parallel longitudinal members that allow the workpiece to be operated on from opposite sides without repositioning the workpiece. The frame and clamping members are particularly configured for receiving and holding workpieces having a rounded cross-section.

17 Claims, 3 Drawing Sheets

APPARATUS FOR CLAMPING A WORKPIECE IN WHICH A MORTISE IS FORMED

TECHNICAL FIELD

The present invention relates to an apparatus for holding a workpiece in which a mortise is to be formed and more particularly to a simple clamping device used to hold a workpiece in which a mortise can be formed from opposite sides of the workpiece.

BACKGROUND OF THE INVENTION

Mortising machines have been used for many years to form holes, grooves, or slots into or through posts or other workpieces. In a typical situation, a mortise, in the form of a rectangular cavity, is cut into a piece of timber or other material which is to receive a tenon. Mortising machines often use a chainsaw type blade for cutting rectangular mortises in fairly large posts. A variety of brackets and devices have been used to hold such a workpiece while the mortise is formed by the mortising machine. These devices have proven difficult to use for holding larger posts or logs, especially rounded posts or logs, while the mortise is being formed.

Some mortise machines have been designed to clamp on to the outer edges of square posts while a mortise is cut but this becomes much more difficult with round logs or posts. When round logs are used, mortises have sometimes been formed by simply drilling holes into the rounded post and then removing the remaining material between the holes with the aid of a hand chisel. This process, however, is time consuming and leaves a poorly formed mortise for receiving a tenon.

Another problem with many of the prior art devices is that the workpiece must be removed and repositioned before the opposite side of the workpiece can be operated on by the mortising machine. For instance, Koster, U.S. Pat. No. 1,015,497, issued Jan. 23, 1912, shows a device for holding a workpiece in which a hole is bored from one direction only. Also, the Koster device is used to hold relatively small workpieces such as chair legs or table legs. The device is not designed to hold a larger post which is subjected to a chainsaw type mortising machine.

A mortising machine, using a chain cutter and a clamping device, is disclosed in Downing, U.S. Pat. No. 112,228, issued Feb. 28, 1871. However, here the device is designed primarily for holding square workpieces. Additionally, the mortise can be formed from only one side of the workpiece unless the workpiece is removed from the device and repositioned.

In Jesson et al., U.S. Pat. No. 410,975, issued Sep. 10, 1889, a device is disclosed which holds rounded workpieces while a mortise is formed. However, once again the rounded workpieces are relatively small umbrella handles and the mortise can only be formed on one side of the umbrella handle without removing the handle from the device.

A device for holding larger posts in which mortises are formed is disclosed in Rahmel, U.S. Pat. No. 1,186,682, issued Jun. 13, 1916. Once again, the Rahmel device is designed to securely hold square posts while the mortise is formed with, for example, a chainsaw mortiser. This device is designed so that the workpiece may quickly be clamped and unclamped allowing it to be moved along a table while mortises are formed at various points along one side of the post. However, a mortise can not be formed from opposite sides of the post without removing the post from the clamping device.

Other similar devices are also shown in the prior art. An endless chain mortising machine is disclosed in Daniels, U.S. Pat. No. 268,003, issued Nov. 28, 1882. Another mortising machine is shown in Kraus, U.S. Pat. No. 306,404, issued Oct. 14, 1884.

The present invention addresses the foregoing drawbacks of known devices.

SUMMARY OF THE INVENTION

The present invention provides an apparatus for holding a workpiece while a mortise is formed in the workpiece by a mortising machine. According to one aspect of the invention, the apparatus has a frame which includes a first longitudinal member and a second longitudinal member both of which lie generally parallel with the longitudinal axis of the frame. A first clamp support and a second clamp support are connected to the frame and disposed between the first and second longitudinal members at opposite longitudinal ends of the frame. A first clamping member which is configured to hold a workpiece in which a mortise is to be formed is disposed between the first and second longitudinal members and supported on the first clamp support. A second clamping member also configured to hold a workpiece in which a mortise is to be formed is similarly disposed between the first and second longitudinal members and supported on the second clamp support. The first and second clamping members are particularly amenable to clamping workpieces having a generally round cross-section.

According to a further aspect of the invention, adjusters are positioned on the clamp supports. The adjusters are used to change or adjust the position of both the first and the second clamping members.

BRIEF DESCRIPTION OF THE DRAWINGS

The invention will hereafter be described with reference to the accompanying drawings, wherein like numerals denote like elements, and.

DETAILED DESCRIPTION OF A PREFERRED EMBODIMENT

Figure 1:
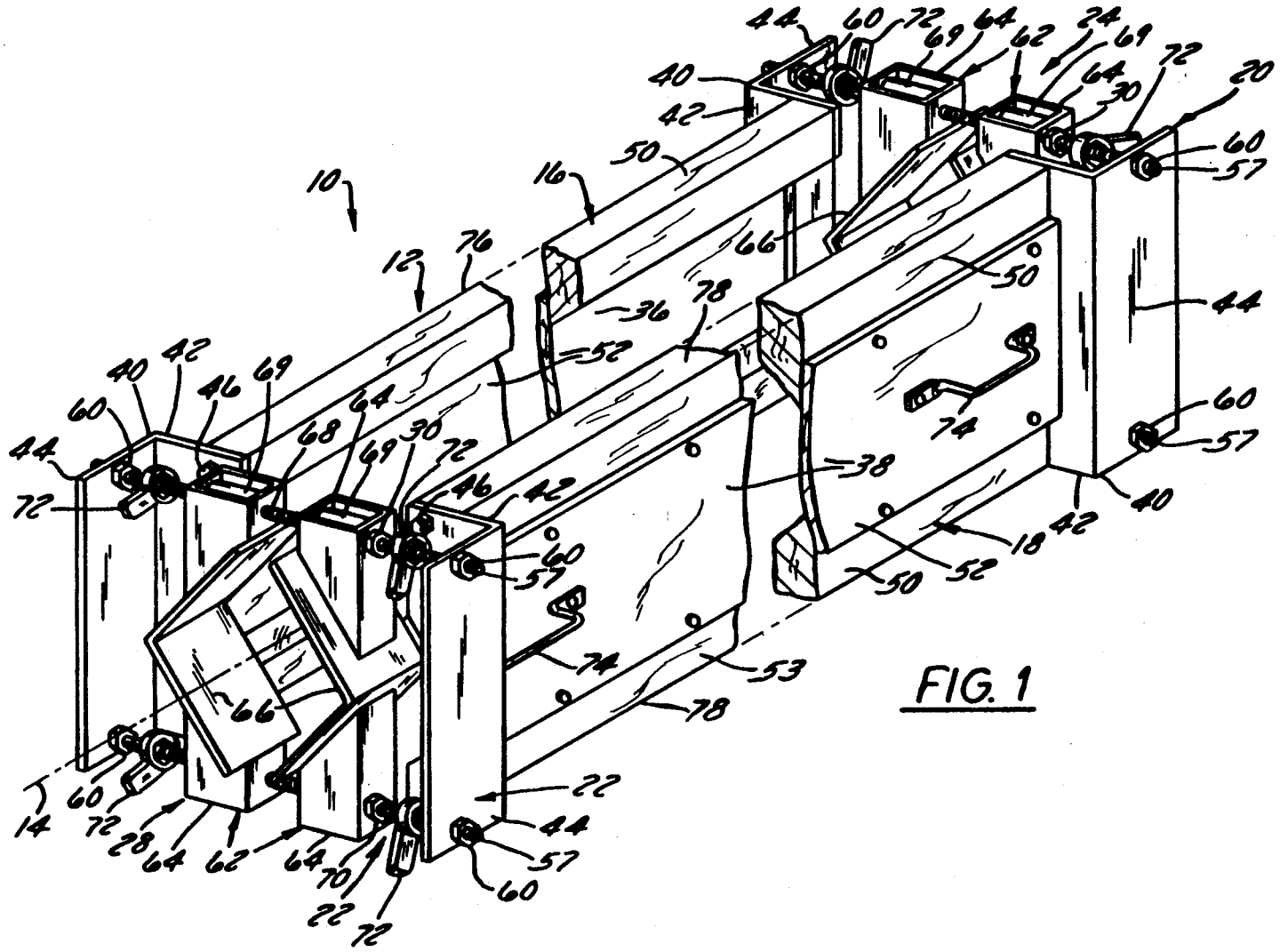
FIG. 1 is a perspective view showing the clamping device to which a mortising machine is attached and in which a workpiece is secured.

Referring now to FIG. 1, a clamping apparatus 10 for holding a workpiece while a mortise is formed in the workpiece, according to the invention, includes a frame 12 having a longitudinal axis 14, a first longitudinal member 16, and a second longitudinal member 18. The longitudinal members, 16 and 18, lie one on each side of longitudinal axis 14 and generally parallel to longitudinal axis 14.

A first clamp support 20 is connected to frame 12 and disposed between longitudinal members 16 and 18 at one longitudinal end of frame 12. A second clamp support 22 is also connected to frame 12 and disposed between first and second longitudinal members 16 and 18 proximate the longitudinal end of frame 12 opposite to first clamp support 20. A first clamping member 24 is supported on first clamp support 20 and is configured to hold a workpiece 26. A second clamping member 28 is supported on second clamp support 22 and is similarly configured to hold workpiece 26 at a spaced distance from clamping member 24.

A plurality of tighteners 30 are provided to tighten clamping members 24 and 28 against workpiece 26. Once the workpiece is secured, a mortising machine 32 may be used to form a mortise in the workpiece.

Each of the above components will now be described in detail with reference to the various Figures.

Figure 2:
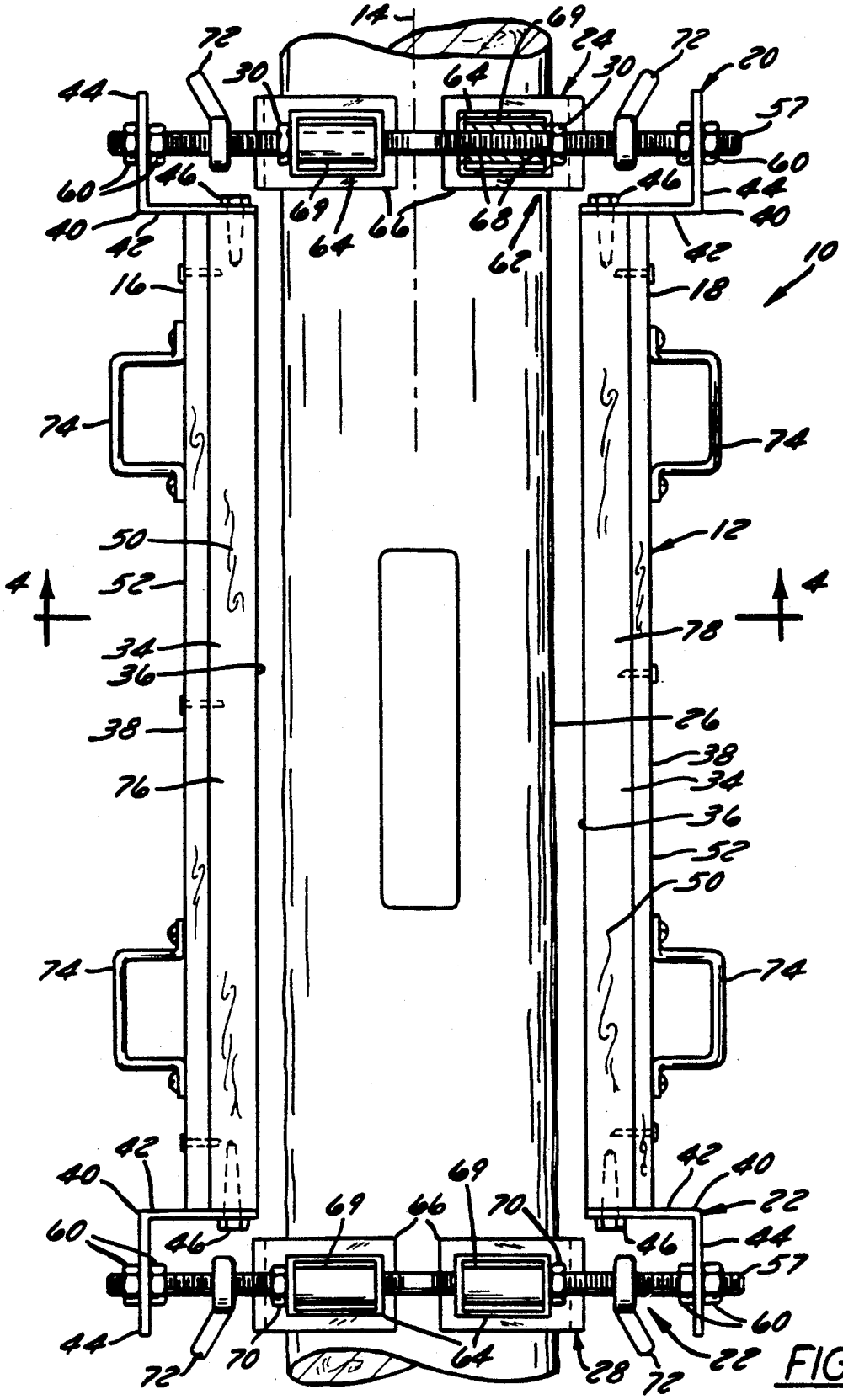
FIG. 2 is a top view of the device.

In a preferred embodiment, longitudinal members 16 and 18 of frame 12 each preferably include a generally planar body portion 34, best viewed in FIG. 2. Body portion 34 includes an inner face 36 which would be oriented towards workpiece 26 when the workpiece is held in clamping members 24 and 28. Body portion 34 also includes an outer face 38.

A pair of brackets 40 are affixed at each longitudinal end of body portion 34. Preferably, brackets 40 extend outward beyond outer face 38 and outward from body portion 34 in a longitudinal direction. In a most preferred embodiment, each bracket 40 has an attachment leg 42 and a support leg 44 extending at a right angle from attachment leg 42. The attachment leg 42 of each bracket is fastened to the longitudinal end of body portion 34 by a fastener 46, which can be any of a variety of fasteners known in the art, and preferably a lag bolt. When attachment leg 42 is fastened securely to body portion 34, support leg 44 is disposed generally parallel to a plane including outer face 38. Support leg 44 extends beyond body portion 34 in a longitudinal direction. Each attachment leg 42 also includes a cutout portion 48, best viewed in FIGS. 3 and 4.

Figure 4:
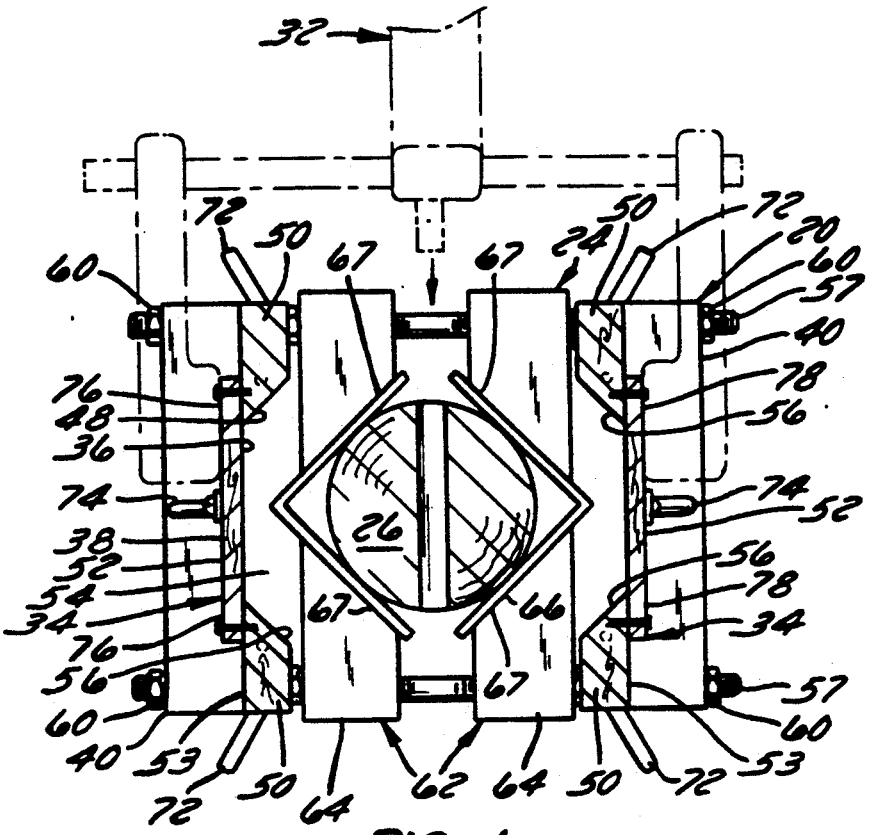
FIG. 4 is a cross-sectional view of the device taken generally along line 4—4 of FIG. 2.

Preferably, body portions 34 each comprise a pair of outer bars 50 which are mounted on a connector bar 52, best viewed in FIG. 4. Connector bar 52 is offset from outer bars 50 and attached adjacent to an exterior surface 53 of outer bars 50. This arrangement leaves a cavity 54 which extends the entire length of body portion 34 and generally aligns with cutout portion 48 to provide more room for workpiece 26 when the workpiece is secured in clamping members 24 and 28. This arrangement also allows for less distance between two exterior surfaces 53 on opposite sides of longitudinal members 16 and 18 on which mortising machine 32 would clamp and still allow for a larger workpiece to be secured in apparatus 10. Preferably, outer bars 50 have a beveled portion 56 which tapers outwardly from connector bar 52 to provide increased space for workpiece 26. Connector bar 52 may be attached to outer bars 50 through a variety of ways known in the art, for example, adhesive or screws.

First clamp support 20 and second clamp support 22 each preferably comprise a rod or rods 57 extending between first and second longitudinal members 16 and 18. Longitudinal members 16 and 18 are affixed to rods 57 in a generally parallel relationship. Preferably, each longitudinal end of first and second longitudinal members 16 and 18 is held by two rods 57, although the number of rods can be varied.

According to one aspect of the invention, rods 57 are affixed to longitudinal members 16 and 18 at respective apertures 58 formed in each of the support legs 44. Rods 56 extend through apertures 58 which are appropriately sized so that longitudinal members 16 and 18 may be moved to different positions along rods 56. This allows the space between longitudinal members 16 and 18 to be adjusted for different size workpieces. Support legs 44 and thus longitudinal members 16 and 18 are held in the desired position by appropriate fasteners 60, such as threaded nuts which are threadably engaged with rods 57 and disposed on either side of support leg 44. The fasteners 60 can be tightened against support leg 44 proximate each aperture 58 to securely affix longitudinal members 16 and 18 to rods 57 in preferably a generally parallel arrangement.

Figure 3:
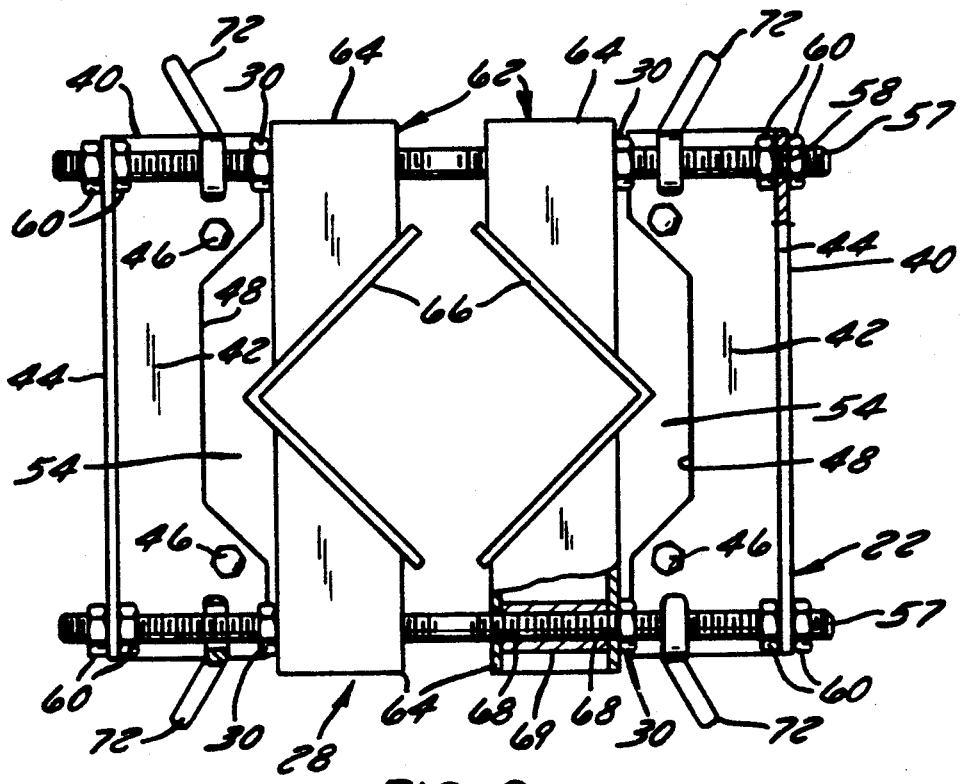
FIG. 3 is an end view, showing the clamping members.

Clamping members 24 and 28 preferably each comprise a pair of post gripping members, each designated generally as 62 in FIG. 3. Each post gripping member 62 includes a brace 64 which is supported by one of the clamp supports 20 or 22. A workpiece contact member 66 is affixed to brace 64 and configured to receive workpiece 26. Post gripping members 62 are oriented on the clamp supports in opposite directions so that workpiece contact members 66 face each other to facilitate gripping of the workpiece between workpiece gripping members 62.

In a preferred embodiment, best viewed in FIG. 2, braces 64 are generally rectangular in cross-section and can be hollow in the center. Holes 68 are formed through braces 64 and are configured to receive rods 57 of clamp supports 20 and 22. Thus, when mounted, post gripping members 62 are slidably engaged with rods 57 and may move in a direction transverse to the longitudinal axis 14. Preferably, each brace 64 includes a pair of bushings 69, best viewed in FIG. 2, which facilitate the sliding of braces 64 along rods 57.

Also in a preferred embodiment, workpiece contact members 66 are configured to grip a post which is round in cross-section. Each contact member 66 is preferably angular in shape and oriented so that the corner of the angle points away from the post, best viewed in FIG. 4. If the post is of generally uniform diameter, each angular contact member 66 will contact the round workpiece at a minimum of two contact points, shown generally as 67. Thus, when a round post is clamped securely at first and second clamping members 24 and 28, there are a minimum of eight contact points 67 which ensures secure gripping of the workpiece. It is preferred that the post is clamped at eight contact points, but contact members 66 will still grip the post sufficiently if there are fewer than eight contact points 67, for instance, if the post if of uneven diameter.

In operation, a workpiece such as a log or post is inserted between workpiece contact members 66 at each clamp support 20 and 22. The workpiece contact members 66 are then tightened against the workpiece by adjusting appropriate tighteners 30. In a preferred embodiment, tighteners 30 are threaded nuts which are threadably engaged with rods 57. Tighteners 30 are turned against braces 64, thus moving workpiece contact members 66 into firm contact with the workpiece. A plurality of wrenches 72 are preferably mounted on rods 57. A single wrench 72 is mounted proximate each tightener 30 so that the tightener may be readily adjusted.

The use of threaded rods and threaded tighteners are only one example of various mechanisms which can be used to tighten the workpiece gripping members 62 against the workpiece. Many other mechanisms are known in the art, for instance, a ratcheting mechanism may be used.

As best shown in FIG. 2, a set of handles 74 may be attached to clamping device 10 to facilitate moving the device or turning the device over so that mortising machine 32 may be attached to an opposite side of clamping device 10. Preferably, handles 74 are attached to connector bars 52 of first and second longitudinal members 16 and 18.

OPERATION

To use clamping device 10, tighteners 30 must be backed off along rods 57 so that workpiece gripping members 62 may be spread far enough apart to receive the workpiece, such as a log or post. Tighteners 30 are then turned in a direction which will move workpiece gripping members 62 towards the workpiece until the workpiece is securely clamped between workpiece contact members 66. Once the clamping members at each end of clamping device 10 are tightened against the workpiece, the workpiece is prevented from rotating about longitudinal axis 14 or from sliding in a longitudinal direction, thus allowing a mortise to be formed in the workpiece.

Mortising machine 32 is then used to form a mortise on either side of the workpiece. A mortise can also be formed in both opposite sides of the workpiece by simply turning clamping device 10 180 degrees about longitudinal axis 14 and forming a mortise on the opposite side of the workpiece.

In a preferred embodiment, first longitudinal member 16 includes a pair of opposed edges 76, as best viewed in FIG. 1, and second longitudinal member 18 includes a pair of opposed edges 78. Edges 76 and 78 are configured to receive a mortising machine which straddles the workpiece as well as edge 76 and edge 78 on one side of the workpiece. Mortising machine 32 may thus be clamped to the edges of first and second longitudinal members 16 and 18 at a multiplicity of points along longitudinal axis 14. Clamping apparatus 10 allows a mortising machine, which could normally only be clamped onto workpieces having a rectangular cross-section, to be used on workpieces that are rounded in cross-section.

Additionally, mortising machine 32 can be positioned over the edge 76 and the edge 78 on either side of workpiece 26, thus allowing a mortise to be formed in the workpiece on either of two opposite sides or both sides. This procedure is accomplished simply by unclamping the mortising machine, turning the clamping device 10 180 degrees, and clamping mortising machine 32 over the appropriate edges on the opposite side of workpiece 26.

A variety of mortising machines may be used, but the preferred machine is the Makita Chain Mortiser, Model 7104L manufactured by Makita Electric Works, Ltd. of Anjo, Aichi, Japan. The Makita mortiser uses a chain cutter and has a ready made clamping fixture which can be clamped over respective edges 76 and 78.

In the Makita Chain Mortiser Model 7104L Instruction Manual, there appears the statement that the Makita machine is for cutting holes in flat-surfaced wood, but clamping apparatus 10 allows this mortising machine to be used with rounded pieces.

It will be understood that the foregoing description is of a preferred exemplary embodiment of this invention, and that the invention is not limited to the specific forms shown. For example, the described workpiece holding members may have various configurations for receiving differently shaped workpieces. The clamping members may use various components for securing the workpiece. The clamp supports may comprise various configurations, including but not limited to different numbers of rods. Additionally, the various components of this clamping device may have different shapes, sizes, or materials. These and other modifications may be made in the design and arrangement of the elements without departing from the scope of the invention as expressed in the appended claims.

What is claimed is:

1. An apparatus for holding a workpiece while a mortise is formed in the workpiece by a mortising machine, said apparatus comprising:

a frame having a longitudinal axis and first and second longitudinal members, wherein said longitudinal members lie generally parallel with said longitudinal axis, each on an opposite side of said longitudinal axis;

a first and second clamp support connected to said frame and disposed between said first and second longitudinal members, said first clamp support being disposed proximate a longitudinal end of said frame and said second clamp support being disposed proximate the longitudinal end of said frame opposite said first clamp support;

a first clamping member, disposed between said first and second longitudinal members and supported on said first clamp support, said clamping member being configured to hold the workpiece in which a mortise is to be formed;

a second clamping member, disposed between said first and second longitudinal members and supported on said second clamp support, said second clamping member being configured to hold the workpiece in which a mortise is to be formed; and means for adjusting the position of said first and second clamping members on said clamp supports.

2. The apparatus for holding a workpiece of claim 1, wherein said first clamping member and said second clamping member each comprise a pair of workpiece gripping members configured to receive a workpiece extending longitudinally between each pair of workpiece gripping members.

3. The apparatus for holding a workpiece of claim 2, wherein said workpiece gripping members are adjustably mounted on said clamp supports to facilitate adjustment of the position of each workpiece gripping member on its respective clamp support and to facilitate the tightening of each workpiece gripping member against a workpiece disposed longitudinally along said longitudinal axis and extending between each pair of workpiece gripping members.

4. The apparatus for holding a workpiece of claim 3, wherein said first clamp support and said second clamp support each comprise a rod extending between said first longitudinal member and said second longitudinal member.

5. The apparatus for holding a workpiece of claim 4, wherein said first clamp support and said second clamp support each comprise a second rod extending between said first longitudinal member and said second longitudinal member.

6. An apparatus for holding a workpiece while a mortise is formed in the workpiece by a mortising machine, said apparatus comprising:

a frame having a longitudinal axis and first and second longitudinal members, wherein said longitudinal members lie generally parallel with said longitudinal axis, each on an opposite side of said longitudinal axis;

a first and second clamp support connected to said frame and disposed between said first and second longitudinal members, said first clamp support being disposed proximate a longitudinal end of said frame and said second clamp support being disposed proximate the longitudinal end of said frame opposite said first clamp support;

a first clamping member, disposed between said first and second longitudinal members and supported on said first clamp support, said clamping member being configured to hold the workpiece in which a mortise is to be formed;

a second clamping member, disposed between said first and second longitudinal members and supported on said second clamp support, said second clamping member being configured to hold the workpiece in which a mortise is to be formed; and means for adjusting the position of said first and second clamping members on said clamp supports, wherein said first clamping member and said second clamping member each comprise a pair of workpiece gripping members configured to receive a workpiece extending longitudinally between each pair of workpiece gripping members, said workpiece gripping members being adjustably mounted on said clamp supports to facilitate adjustment of the position of each workpiece gripping member on its respective clamp support and to facilitate the tightening of each workpiece gripping member against the workpiece, further wherein said first clamp support and said second clamp support each comprise a first rod and a second rod each of said rods extending between said first longitudinal member and said second longitudinal member, and further wherein said first longitudinal member and said second longitudinal member each comprises an edge configured for receiving and supporting the mortising machine in a position straddling said first and second longitudinal members.

7. The apparatus for holding a workpiece of claim 6, wherein said first longitudinal member and said second longitudinal member each comprise a second edge disposed on an opposite side of each longitudinal member from said first edge, said second edge being configured for receiving and supporting the mortising machine in a position straddling said first and second longitudinal members.

8. The apparatus for holding a workpiece of claim 7, wherein said clamping members are configured for receiving and holding a round post.

9. The apparatus for holding a workpiece of claim 7, wherein each said workpiece gripping member includes an angular portion disposed generally between said first rod and said second rod of each said clamp support and configured for contacting and holding the workpiece.

10. The apparatus for holding a workpiece of claim 9, wherein said rods of said clamp supports are threaded.

11. The apparatus for holding a workpiece of claim 10, wherein said first and second clamping members each include a pair of apertures through which said first and said second rod extend, respectively, said apertures being of appropriate size to facilitate sliding engagement with said rods.

12. The apparatus for holding a workpiece of claim 11, wherein said adjusting means comprises a plurality of adjustment nuts threadably engaged with said rods and configured for abutting engagement with said clamping members, whereby said clamping members are forced to move along said rods in a direction transverse to said longitudinal members when said adjustment nuts are rotated on said rod thereby moving them towards said clamping member.

13. The apparatus for holding a workpiece of claim 12, further comprising a plurality of wrenches connected to said rods.

14. The apparatus for holding a workpiece of claim 13, further comprising a handle connected to said frame.

15. The apparatus for holding a workpiece of claim 9, wherein said workpiece gripping members contact the workpiece at eight contact points.

16. An apparatus for holding a workpiece while a mortise is formed in the workpiece by a mortising machine, said apparatus comprising:

a frame having a longitudinal axis and first and second longitudinal members, wherein said longitudinal members lie generally parallel with said longitudinal axis, each on an opposite side of said longitudinal axis;

a first and second clamp support connected to said frame and disposed between said first and second longitudinal members, said first clamp support being disposed proximate a longitudinal end of said frame and said second clamp support being disposed proximate the longitudinal end of said frame opposite said first clamp support;

a first clamping member, disposed between said first and second longitudinal members and supported on said first clamp support, said clamping member being configured to hold the workpiece in which a mortise is to be formed;

a second clamping member, disposed between said first and second longitudinal members and supported on said second clamp support, said second clamping member being configured to hold the workpiece in which a mortise is to be formed; and a tightener cooperating with said first and second clamping members to adjust the position of said first and second clamping members on said first and second clamp supports.

17. The apparatus of claim 16, wherein said tightener comprises a first tightener and a second tightener cooperating with said first clamping member and said second clamping member respectively.

* * * * *